US006439313B1

(12) United States Patent
Thomeer et al.

(10) Patent No.: US 6,439,313 B1
(45) Date of Patent: Aug. 27, 2002

(54) DOWNHOLE MACHINING OF WELL COMPLETION EQUIPMENT

(75) Inventors: Hubertus V. Thomeer, Houston; James Michael Costley, Freeport; Randolph J. Sheffield, Missouri City, all of TX (US); David M. Eslinger, Broken Arrow, OK (US); Marc Allcorn, Houston; Mark C. Oettli, Richmond, both of TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 46 days.

(21) Appl. No.: 09/666,724

(22) Filed: Sep. 20, 2000

(51) Int. Cl.[7] ..... E21B 29/00

(52) U.S. Cl. ..... 166/361; 166/298; 166/376; 166/54.6; 166/55.8

(58) Field of Search ..... 166/361, 376, 166/298, 277, 297, 54.5, 54.6, 55, 55.1–55.3, 55.6, 55.8

(56) References Cited

U.S. PATENT DOCUMENTS 4,134,453 A 1/1979 Love et al. ..... 166/298
4,494,601 A * 1/1985 Pratt et al.
5,366,015 A 11/1994 Surjaatmadja et al. ..... 166/298
5,370,183 A * 12/1994 Ellis et al.
5,390,737 A * 2/1995 Jacobi et al.
5,839,515 A * 11/1998 Yuan et al.
5,976,330 A 11/1999 Ziegler et al. ..... 204/224
5,979,519 A 11/1999 Susnjara ..... 144/48.1
5,988,961 A 11/1999 Kameyama ..... 409/233
6,000,113 A 12/1999 Owariya ..... 29/33

* cited by examiner

*Primary Examiner*—Roger Schoeppel
(74) *Attorney, Agent, or Firm*—Stephen Schlather; Brigitte L. Jeffery; John J. Ryberg

(57) ABSTRACT

A method of machining a workpiece in a subterranean wellbore comprises the steps of: (a) providing a workpiece that comprises (1) a first section that comprises a first material, and (2) a second section that comprises a second material, the second section forming at least one surface of the workpiece; (b) placing the workpiece in a subterranean wellbore that is surrounded by a geologic formation; and (c) machining the workpiece to remove at least part of the second material in the second section, whereby at least one surface of the workpiece is formed into a desired configuration. This method allows, for example, a landing nipple to be installed in a wellbore, and customized locking recesses to be formed in the inner surface of the nipple at a later time.

20 Claims, 4 Drawing Sheets

DOWNHOLE MACHINING OF WELL COMPLETION EQUIPMENT

TECHNICAL FIELD OF THE INVENTION

This invention relates to the equipment and methods used in the completion of wells, such as oil and gas wells, and in particular to downhole machining of completion equipment.

BACKGROUND OF THE INVENTION

Hydrocarbon fluids such as oil and natural gas are obtained from a subterranean geologic formation (i.e., a "reservoir") by drilling a well that penetrates the hydrocarbon-bearing formation. Once a wellbore has been drilled, the well must be "completed" before hydrocarbons can be produced from the well. A completion involves the design, selection, and installation of tubulars, tools, and other equipment that are located in the wellbore for the purpose of conveying, pumping, or controlling the production or injection of fluids. The maintenance, operation, adaptability, and management of the completion must be considered as well. The completion of a well represents a complex technology that has evolved around the technique and equipment developed for this purpose.

Completion generally includes the installation of casing and one or more tubing strings in the wellbore, cementing, the installation of a variety of downhole equipment, such as packers and flow control devices, and in most cases perforating the casing to allow the hydrocarbons to flow from the formation into the wellbore. It is customary to install completion equipment that is particularly adapted for the specific well involved. Thus, commonly used types of completion equipment, such as landing nipples, packers, and flow control valves, are typically available in a variety of sizes and configurations, so that a particular size and configuration can be selected that will be best suited to work in the well in conjunction with the other equipment that is also installed in that well.

As a more specific example, as part of the completion practice, the control of fluid within the tubing and the flow of fluid from tubing to casing, or vice versa, is an important feature of flow control equipment. In order to properly construct a flow control system, any number of seating locations must be available in which the specified flow control devices can be installed. Landing or seating nipples are distributed throughout the tubing string as a method to locate and latch different flow control mechanisms. These nipples come with a variety of internal diameters and locking recesses in order to properly locate pre-selected equipment in place at the correct depth. When the desired tool is lowered into a well by wireline or the like, co-acting locking means on the tool can engage a corresponding locking recess on the landing nipple. Thus, by using a plurality of landing nipples in a well that have a different inner diameters as well as sizes or shapes of locking recesses, downhole tools can be selectively installed by matching the size and shape of the tool's locking means to the corresponding locking recess on the desired landing nipple. Significant planning is involved in specifying the correct nipple sequences so that the desired flow-control devices can reach their targets. In addition to the necessary planning, there is must be a substantial inventory of nipples in terms of style and quantity in order to provide an acceptable arrangement of the flow control system downhole. A method of completing wells that would allow more use of standard completion equipment would make the completion process less expensive and would reduce the need for inventories of many different sizes and configurations of a given type of downhole equipment.

Packers are one commonly used type of completion equipment. A permanent packer is preferred over a temporary removable packer under a variety of conditions, including potentially hostile environments in terms of pressure, temperature and fluid exposure. The packer is expected to be in the wellbore for long periods of time. The permanent packer has certain advantages in terms of capacity and functionality in comparison to other types of packers. However, the permanent packer is difficult to remove from the wellbore, and attempting to do so typically requires a milling operation to remove an anchor, which involves significant planning and time. There are also semi-permanent packers which can be placed in a well but can also be retrieved without milling and destroying the packer, thereby potentially allowing the packer to be reused. A need exists for improved methods of removing permanent packers from wellbores.

Downhole alteration of completion equipment has been used only on a limited basis in the past. One common downhole alteration is the use of a jet perforating gun to form holes in the well casing, and thus create a flow path for hydrocarbons to pass from the formation into the wellbore. Another such technique that has been used is to cut slots in well casing by lowering a jet nozzle into a well and pumping a fluid through the nozzle radially outward against the casing, at a high enough pressure to cut holes or slots in the casing. One embodiment of this technique is described in U.S. Pat. No. 4,134,453. The above-described uses of downhole cutting or perforation of well completion equipment have not eliminated the need for many sizes and configurations of equipment such as landing nipples, packers, and a variety of downhole tools.

In general, there is a long-standing need for simpler and less expensive methods of completing wells.

SUMMARY OF THE INVENTION

The present invention relates to a method of machining a workpiece in a subterranean wellbore. The method comprising the steps of: (a) providing a workpiece that comprises (1) a first section that comprises a first material, and (2) a second section that comprises a second material, the second section forming at least one surface of the workpiece; (b) placing the workpiece in a subterranean wellbore that is surrounded by a geologic formation; and (c) machining the workpiece to remove at least part of the second material in the second section, so that at least one surface of the workpiece is formed into a desired configuration.

In some embodiments of the invention, the machining in step (c) substantially destroys the second section of the workpiece. "Machining" in this context includes mechanical, electrical, and chemical techniques of removing material, as well as methods that involve combinations of these approaches. "Substantially destroys" in this context means that the second section is reduced to small particles that can easily be pushed out of the way by a downhole tool or by a flow of fluid. In essence, "substantially destroying" the second section removes that section as a fixed structure, so that mechanical or other operations may take place in the space that was previously occupied by that second section. In this embodiment of the invention, the destruction of the second section can allow the retrieval of the remainder of the workpiece (e.g., a permanent packer) from the wellbore.

In another embodiment of the invention, the workpiece is a tubular member (e.g., a landing nipple) having a hollow axial bore therethrough and an opening at each end. Preferably, the first section comprises an outer tubular member having a hollow axial bore therethrough and having a inner surface and an outer surface. It is also preferred that the second section comprises an inner tubular member having an inner surface and an outer surface, and that the outer surface of the inner tubular member is in fixed contact with the inner surface of the outer tubular member. In other words, the inner tubular member and the outer tubular member are connected in a fixed manner to form a combined tubular structure.

In an especially preferred embodiment of the invention, the inner surface of the inner tubular member is cylindrical and has a substantially uniform inner diameter along its axial length prior to the machining in step (c). In other words, the inner surface presents a smooth profile to any downhole tools that are lowered past that surface. The absence of sharp edges or a complex profile of indentations helps prevent downhole tools from hanging up on the inner surface of the workpiece and provides a pressure barrier. When the time arrives to install a downhole tool in the workpiece, the machining of step (c) can remove at least part of the second material from the inner surface of the inner tubular member in a predetermined pattern, thereby forming a locking profile in the inner surface of the inner tubular member. "Locking profile" as used herein means a contour on the inner surface of the inner tubular member that comprises at least one locking recess. The locking profile will typically be adapted to engage locking members on a downhole tool. Preferably, the locking profile comprises a locking recess, a sealing section, and a no-go section that has a smaller inner diameter than the locking recess or the sealing section.

Thus, one embodiment of the present invention includes the additional step of placing a downhole tool in the axial bore of the workpiece and activating at least one locking member on the downhole tool to engage the locking profile on the workpiece, after that locking profile has been formed by the machining.

In another embodiment of the invention, the first section of the workpiece comprises a tubular member having a hollow axial bore therethrough and having an inner surface and an outer surface, and the tubular member has a plurality of apertures therein extending from the inner surface to the outer surface. Also in this embodiment, the second section comprises a plurality of closure members that seal the plurality of apertures in the tubular member. Therefore, in its initial state, the workpiece is a tubular member that has a solid wall all the way around its circumference. Then, when the time arrives to form one or more holes in the wall of this tubular member, the machining in step (c) can remove sufficient second material from at least one of the apertures so as to establish a path for fluid flow between the axial bore and the outer surface of the tubular member. Usually, the machining in step (c) is performed to open a fluid flow path through a plurality of the apertures.

The path for fluid flow (i.e., the hole opened by the machining) will often be located approximately at a depth in the subterranean wellbore from which hydrocarbon fluids are to be produced from the geologic formation into the wellbore. Alternatively, the path for fluid flow can be located approximately at a depth in the subterranean wellbore at which fluids are to be injected from the wellbore into the geologic formation.

The first and second sections of the workpiece can be made of a variety of materials, but preferably the second material is more readily removed by machining than the first material. The first material preferably comprises steel or other metal but may also be some form of carbide or ceramic structure. Suitable second materials include metals such as copper, brass, aluminum, nickel, or lead; and composites such as plastics, elastomers, or epoxies, with or without reinforcing fibers such as glass, carbon, Kevlar, or graphite.

The machining can be performed in a variety of ways. Examples of suitable machining processes include: contact abrasion or cutting by a rotating cutting member; electrochemical machining; electrical discharge machining; chemical machining; fluid jet milling; plasma milling; and laser milling. It would also be possible to use combinations of two or more of these processes, for example in a sequential manner. Preferably, the machining is performed by a downhole machining apparatus that is suspended within the bore of the workpiece by a structure selected from the group consisting of wireline, coiled tubing, electrical power cable, and combinations thereof.

Another aspect of the present invention is a downhole assembly that comprises a downhole workpiece located in a subterranean wellbore, the workpiece comprising (1) a first section that comprises a first material, and (2) a second section that comprises a second material, the second section forming at least one surface of the workpiece, wherein the second material is more readily removed by machining than the first material. The downhole workpiece can take a variety of forms, as outlined above. The assembly can also include a downhole tool located in the axial bore of the workpiece and comprising at least one locking member on the downhole tool that engages a locking profile on the workpiece.

Prior to installation of a downhole tool in engagement with a locking profile on the workpiece, the assembly can also comprise a downhole machining apparatus that is suspended within the bore of the workpiece by wireline, coiled tubing, electrical power cable, or the like.

The present invention can reduce the complexity of building, maintaining, and operating a well completion. It can permit the use and storage of fewer completion components for any particular well program. For example, the ability to custom machine a workpiece downhole reduces the need to maintain an inventory of similar equipment having many different configurations (i.e., landing nipples having different locking profiles). A separate benefit of some embodiments of the method is enhanced flexibility of the selected completion components by enabling more component functionality and by providing easier access to the components.

Downhole machining can permit the development of sophisticated completions with fewer inventory concerns and without creating complex tubular profiles before they are needed. For example, removing the complex profiles on the inner surface of wellbore tubular equipment reduces the locations where tools and flow control devices can get hung-up or located incorrectly. A smoother bore also reduces the locations where corrosion and scale have growth sites. The downhole machining method of the present invention can permit one or more of a wide range of activities, including destruction, retrieval, manipulation, and construction of completion components as needed.

The machining techniques can also provide means for manipulation or retrieval of completion components beyond conventional mechanisms. As one particular example, use of the present invention in a permanent packer can reduce the effort and increase the chances of success in attempting to retrieve this type of packer. In some embodiments, a packer of the present invention can be locked in place in a well, and a downhole tool subsequently can remove a selected portion of the packer.

The present invention can also increase the flexibility in building a flow control system in the completion, particularly with regard to the identification and location of landing nipples, the ability to create lock recesses of different sizes, shapes, and functions as required, and the eduction of inventory.

DETAILED DESCRIPTION IF PREFERRED EMBODIMENTS

Figure 1:
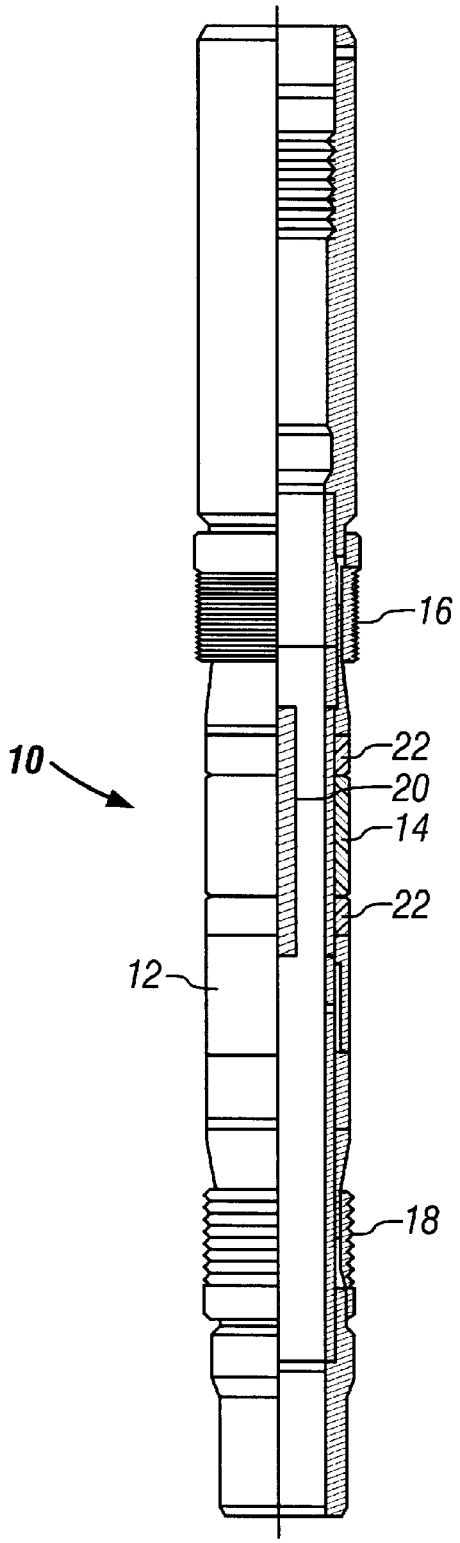
FIG. 1 is a cross-sectional view of a downhole assembly that includes a packer of the present invention.

The downhole machining methods of the present invention can make use of machining techniques that utilize a combination of rotating tools and/or workpieces. Machining operations such as drilling, cutting, grinding, milling, or others can be performed. Alternatively, machining methods that employ the placement of chemicals, electrical power, or a combination of both between the tools and workpiece can be utilized. Such techniques include electro-chemical machining, electrical discharge machining, electrical discharge grinding, electrical discharge texturing, electrochemical drilling, chemical milling, and others. Another suitable technique performs the required machining using fluid power. Jetting of clean fluids, fluids with abrasives (either in suspension or introduced at the tool-workpiece interface), or reactive fluids can be used to alter completion hardware through machining. Likewise, the use of laser power or plasmas can be employed as a machining method. Regardless of the particular technique used, the machining method preferably permits both gross and precise operations to be applied to downhole completion components. These operations can be used in the destruction, manufacture, manipulation, or retrieval of completion items in the downhole environment. Similarly, a combination of machining operations will permit new downhole completion components to be created in-situ in the wellbore.

Another important aspect of machining downhole is the ability to selectively machine or manipulate preferential materials in the wellbore. Depending on the chosen machining method, ferrous and non-ferrous metals and alloys can be targeted individually for machining. Similarly, the use of composites, plastics, or other matrix-materials (i.e. combination of metals and plastics or composites) allows the individual components to be selected while machining downhole.

Suitable matrix materials can include, but are not limited to, metallic, ceramic, polymer, carbon, and intermetallic materials. Suitable polymers include thermoplastic and thermoset polymers, with polyethylene being one particular example. Suitable fibers for inclusion in the matrix materials include, but are not limited to, aramid, carbon, ceramic, and metallic fibers.

Suitable systems for delivering the machining operations downhole include the use of coiled tubing, electrical power line, conventional hoist lines, or other conveyance systems. For example, coiled tubing can be used to supply chemical or fluid power, electrical power, or a combination of the above either individually or simultaneously as required. The utilization and supply of local power at the application of the machining operation permits the use of either passive or active conveyance techniques.

A permanent packer is preferred in a completion under a variety of conditions, especially hostile environments in terms of pressure, temperature and fluid exposure. Although a permanent packer has certain advantages in terms of reliability and operating performance in comparison to other types of packers, it is more difficult to remove from the wellbore. If the proper downhole machining technique and material selection for the packer are combined, a reduction in the effort and an increase in the success of retrieval of the permanent packer are obtainable. Providing a means via downhole machining to improve the retrievability of the permanent packer brings operational benefits in terms of completion design and performance, even where temporary retrievable packers have been called for in the past.

FIG. 1 shows one embodiment of the use of a matrix-material in the packer to aid in its machining and subsequent retrieval without affecting its performance. The downhole assembly includes one or more elements 14 that are typically made from rubber and can extrude out to form a fluid seal between the casing or tubing wall and the packer. The packer comprises a first section 12, typically made of steel, and a second section 20, made of a matrix material. The packer also comprises slips 16 and 18 which can extend out to the casing or tubing wall to prevent the packer from sliding up or down after the packer has been set. The packer also includes one or more spacers 22, also referred to as anti-extrusion rings, which control the gap between the packer and the casing or tubing wall, and are located between or on both sides of the elements. The spacers 22 prevent the elements from extruding under pressure.

When the second section is substantially destroyed by downhole machining, access is then available to the expandable rings and elements 14 in the first section of the packer. This permits retrieval of the packer from the wellbore without the traditional milling difficulties and formation of heavy debris.

Another important use of the present invention is in landing nipples. In a typical well completion, landing or seating nipples are distributed throughout the tubing string as a method to locate and latch different flow control mechanisms. These nipples come with a variety of internal diameters and locking recesses in order to properly locate pre-selected equipment in place at the correct depth.

Figure 2A:
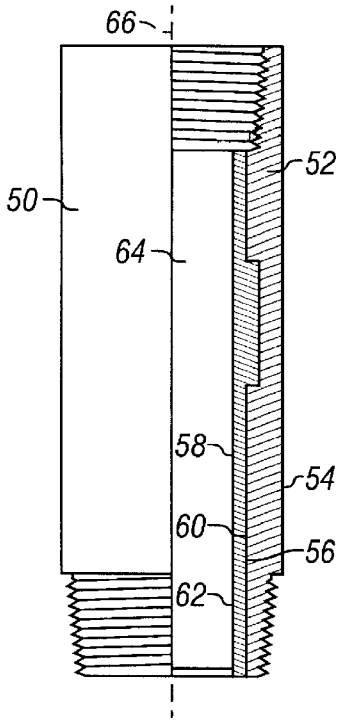
FIGS. 2A, 2B, and 2C are cross-sectional views of a landing nipple of the present invention, before and after downhole machining, and with a downhole tool installed, respectively.
Figure 2B:
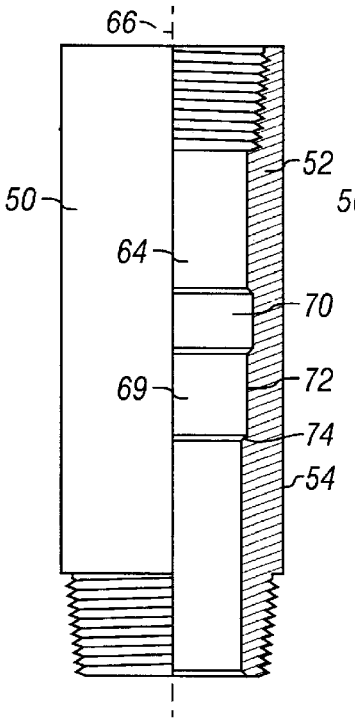

FIGS. 2A and 2B shows one embodiment of a landing nipple in accordance with the present invention. The landing nipple 50 comprises a first section 52 in the form of an outer tubular member. This outer tubular member has an outer surface 54 and an inner surface 56. The nipple also comprises a second section 58 in the form of an inner tubular member. This inner tubular member likewise has an outer surface 60 and an inner surface 62. The outer surface 60 of the inner tubular member and the inner surface 56 of the outer tubular member are in contact with each other, such that the inner and outer tubular members (i.e., the first and second sections of the nipple) form a combined structure. The nipple 50 has a hollow bore 64 along its longitudinal axis 66.

The nipple 50 is installed in the well in the form shown in FIG. 2A. The smooth inner surface 62 of the inner tubular member makes this nipple unlikely to snag tools that are lowered into the well and through its bore 64. When it is time to install a tool (e.g., a flow control valve) in the nipple, downhole machining is used to remove all or part of the second material to form as modified inner surface 69. This modified inner surface is in the form of a locking profile that includes a locking recess 70, a sealing section 72, and a no-go section 74. The desired tool has locking projections, which can be activated to extend outward into engagement with the locking recess 72. The tool will typically have a sealing surface that will contact the sealing section 72 of the profile. The outer diameter of the tool will usually be sufficiently large that it cannot pass the no-go section 74 of the nipple.

Figure 2C:
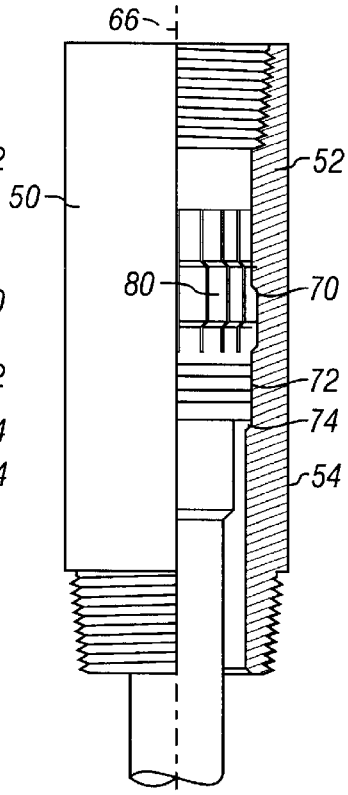

FIG. 2C shows a downhole tool 80 locked into place in the nipple of FIG. 2B.

Other applications of the present invention include the use of downhole machining to open and close flow paths built into flow control hardware. Examples of this type of hardware include slotted liners, screens, and sliding sleeves. One of the major benefits of the method is the ability to activate different production or flow regions while avoiding the problems, such as the inability to operate a sleeve, associated with clogged ports or openings due to corrosion or debris buildup.

The downhole machining operation can be used in conjunction with sophisticated combinations of materials so that target locations can be more easily identified and utilized. One example is a tubular that has built-in windows, which are not necessarily obvious to the naked eye until the downhole machining operations are carried out.

Figure 3A:
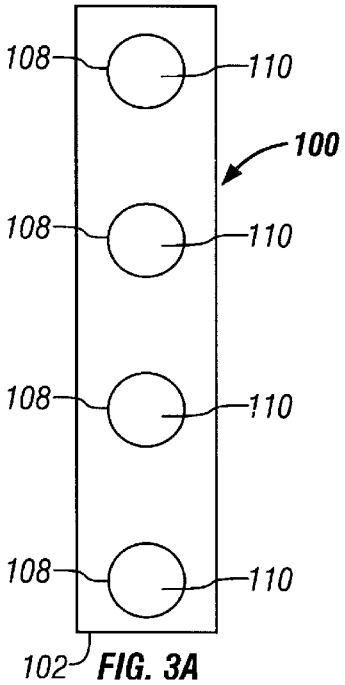
FIGS. 3A and 3B are side views of a well tubular of the present invention, before and after downhole machining opens one or more windows in the walls of the tubular member.
Figure 3B:
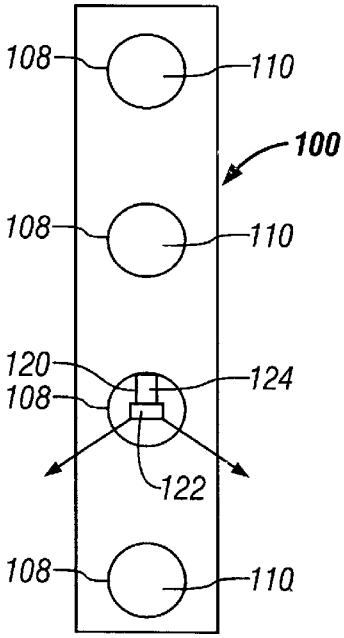
Figure 3C:
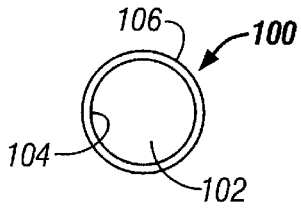
FIG. 3C is an overhead view of the well tubular of FIGS. 3A and 3B.

FIGS. 3A–3C show an example of a tubular that would utilize a matrix material, such as PEEK (polyetheretherketone), PPS (polyphenylene sulfide), or epoxy with glass fibers, and a selective machining technique to build exit windows for outside communication or for building multilateral wellbores. In FIG. 3A, the first section of the workpiece is a tubular member 100, shown from the side in its initial state. FIG. 3C shows a top view of this tubular. A hollow axial bore 102 exists through the tubular. The tubular has an inner surface 104 and an outer surface 106, and is preferably circular in cross-section. A plurality of apertures 108 are formed in the wall of the tubular, extending from the bore 102 to the outer surface 106 of the tubular. In effect, these apertures form flow paths from the bore to the outside of the tubular, or vice versa. However, in the state shown in FIG. 3A, these apertures are sealed by the second section of the workpiece, which in this case is in the form of a plurality of closure members 110. These closure members 110, which are preferably made of a different material than the tubular member 100, in effect create a unitary tubular structure with a solid wall having no flow paths therein.

When it is time to open a flow path through one or more of the apertures 108, a downhole machining apparatus 120 is lowered through the wellbore and into the bore 102 of the tubular 100. This embodiment of the machining apparatus 120 includes a fluid nozzle 122, which is attached to coiled tubing 124. The coiled tubing both supplies fluid to the nozzle and acts as a mechanical support for the nozzle. Fluid (such as water, concentrated acids such as HCl, xylene mixtures, or fluid slurries containing abrasive particles such as sand) is then sprayed out through the nozzle at high pressure (e.g., at least about 1,500 psi), such that the second material that forms the closure member 110 is machined away, thus opening a fluid flow path. This path can be used for production of fluids from the formation into the bore, for injection of fluids from the bore into the formation, for construction of multilateral boreholes, or for other purposes that will be recognized by those skilled in the well completion field.

Figure 4:
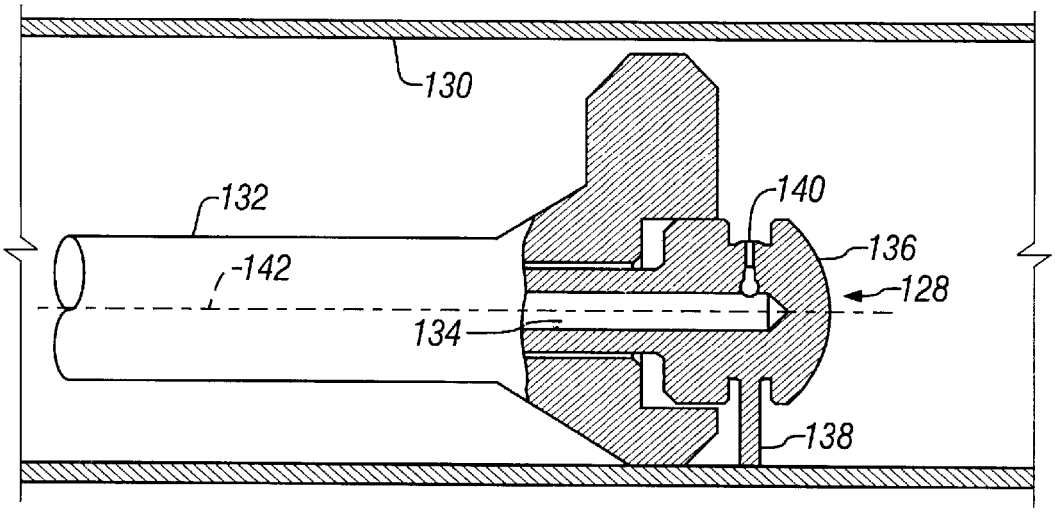
FIG. 4 is a cross-sectional view of a downhole machining apparatus.

Another type of downhole machining apparatus is shown in FIG. 4. The machining apparatus 128 is placed downhole in well tubing 130. The apparatus 128 comprises an elongated cylindrical housing 132 having a hollow fluid channel 134 therein, and a machining head 136. Fluid can be pumped under pressure through the fluid channel 134, for example from the surface of the well. The fluid flows from the fluid channel 134 through a jet orifice 140, causing the head 136 to rotate in the housing 132 around its longitudinal axis 142. The fluid pressure also causes a retractable cutting blade 138 to extend radially outward. When the blade 138 is extended and the head 136 is rotating, the blade machines material from the inner wall of the tubing 130.

Figure 5:
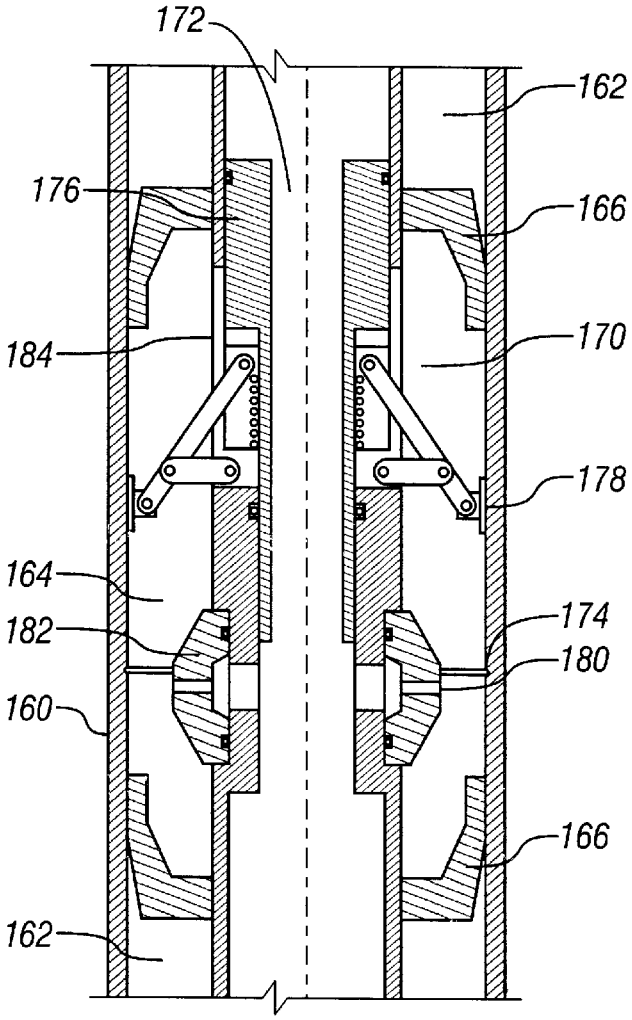
FIG. 5 is a cross-sectional view of another downhole machining apparatus.

Yet another type of suitable downhole machining apparatus is shown in FIG. 5. Well tubing 160 contains wellbore fluid 162. The downhole machining apparatus 170 comprises a housing 184 and is placed downhole within the tubing. A non-conductive fluid, such as BP 200T, BP 200, Chem Finish EDM 3001 Lite, or Chem Finish EDM 3033, is pumped under pressure through a longitudinal fluid channel 172 in the center of the machining apparatus 170. The fluid pressure causes anodes 174 to extend radially outward, and pushes against a piston 176 which in turn extends electrodes 178 radially outward until they come in contact with the inner wall of the tubing 160. The fluid flows through a jet orifice 180, causing an anode head 182 to rotate, and causing the non-conductive fluid to fill the annulus 164 between two fluid barriers 166. An electrical current flows through the electrode 178 into the tubing 160, and sparks to the anode 174. During each spark, material is removed from the tubing 160.

Certain embodiments of the present invention provide the ability to install tubular members in a wellbore, and at a later time bring a downhole tool, such as a lathe or electro-discharge machining device, into the vicinity of the tubular, to machine the tubular structure to create a desired profile and/or alternative fluid communication path. The downhole tool can be run into the well on slickline, wireline, jointed pipe, or coiled tubing, for example. This reduces the cost of maintaining inventory, since a standard tubular member can be machined to the desired configuration downhole.

Another embodiment of the invention can be used to place a patch or similar structure downhole, for example to patch a damaged area on a well tubular. For example, a workpiece could be placed at the desired location in a borehole, machined to the necessary patch configuration, and then a downhole welding tool or the like can be run into the wellbore on slickline, wireline, jointed pipe, or coiled tubing, to weld the patch into place.

Another alternative embodiment of the invention uses a downhole tool that comprises measuring devices to measure the results of the downhole machining, thereby permitting enhanced quality control.

Another embodiment of the invention involves machining away critical areas of existing downhole equipment that was designed to be retrievable, but whose retrieval function has failed. For example, this problem arises in dual packers and single packers that have been in place in a well for many years. The use of the downhole machining techniques of the present invention would allow removal of such a device, despite the failure of its original retrieval function.

Figure 6A:
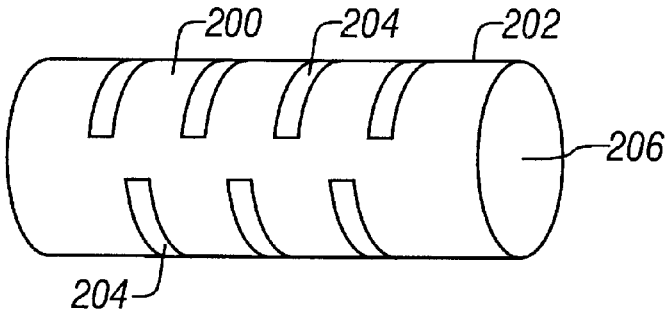
FIG. 6A is a perspective view of a slotted sleeve of the present invention having a compressed configuration.
Figure 6B:
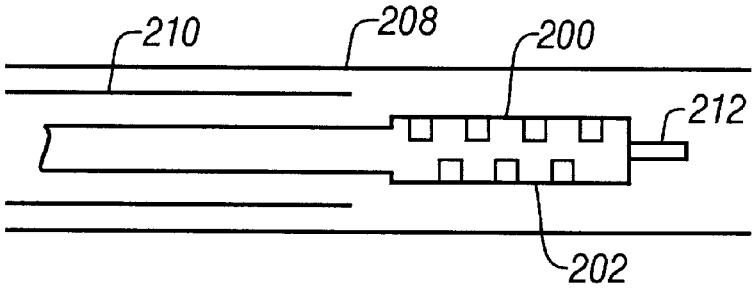
FIGS. 6B and 6C are cross-sectional views of the use of the slotted sleeve of FIG. 6A.
Figure 6C:
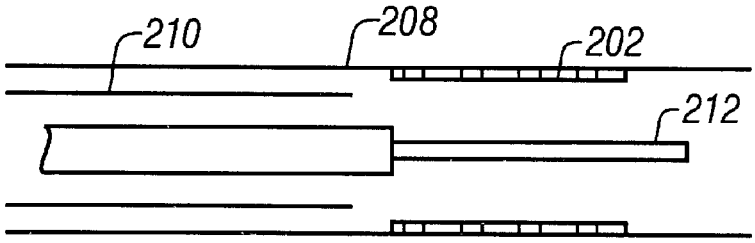

Yet another embodiment of the invention comprises a slotted sleeve that can be run into a borehole in a compressed configuration, and then expanded downhole as a result of downhole machining. As shown in FIG. 6A, the workpiece can comprise a slotted sleeve 200 having a cylindrical wall 202 and a plurality of slots or apertures 204 therein. Inside (and optionally outside) the wall 202 is a second material 206 that holds the wall in a compressed configuration. Suitable second materials for this type of application include epoxy, brazing, and the like. The sleeve 200 preferably has pressure integrity and can be run in the wellbore as part of the completion. This is depicted in FIG. 6B, where 208 is the well casing and 210 is the well tubing. Then, in the same run or a later run, a downhole machining tool 212 removes some or all of the second material, for example by jetting, cutting, or dissolving. When this happens, a pre-existing bias in the cylindrical wall 202 causes it to expand radially, since it is no longer held in the compressed configuration by the second material. Therefore, the wall 202 of the sleeve can expand into contact with the casing 208.

The preceding description of specific embodiments of the present invention is not intended to be a complete list of every possible embodiment of the invention. Persons skilled in this field will recognize that modifications can be made to the specific embodiments described here that would be within the scope of the present invention.

What is claimed is:

1. A downhole assembly, comprising:

a downhole workpiece located in a subterranean wellbore, the workpiece comprising:

(1) a first section that comprises a first material, and (2) a second section that comprises a second material wherein the second material is more readily removed by machining than the first material, the second section forming at least one surface of the workpiece;

wherein the first section comprises an outer tubular member having a hollow axial bore therethrough and having a inner surface and an outer surface; and wherein the second section comprises an inner tubular member having an inner surface and an outer surface, and wherein the outer surface of the inner tubular member is in fixed contact with the inner surface of the outer tubular member and the inner surface of the inner tubular member forms a locking profile.

2. The assembly of claim 1, wherein the locking profile is adapted to engage locking members on a downhole tool.

3. The assembly of claim 1, further comprising a downhole tool located in the axial bore of the workpiece and comprising at least one locking member on the downhole tool that engages the locking profile on the workpiece.

4. The assembly of claim 1, wherein the first section comprises a tubular member having a hollow axial bore therethrough and having an inner surface and an outer surface, and wherein the tubular member comprises a plurality of apertures therein extending from the inner surface to the outer surface; and wherein the second section comprises a plurality of closure members that seal the plurality of apertures in the tubular member thereby providing a substantially smooth bore along the length of the member.

5. The assembly of claim 4, further comprising an open path through at least one of the apertures that allows fluid flow between the axial bore and the outer surface of the tubular member.

6. The assembly of claim 5, wherein open paths that allow fluid flow exist through a plurality of the apertures.

7. The assembly of claim 5, wherein the path for fluid flow is located approximately at a depth in the subterranean wellbore from which hydrocarbon fluids are to be produced from the geologic formation into the wellbore.

8. The assembly of claim 5, wherein the path for fluid flow is located approximately at a depth in the subterranean wellbore at which fluids are to be injected from the wellbore into the geologic formation.

9. A method of machining a workpiece in a subterranean wellbore, comprising the steps of:

(a) providing a tubular member having a hollow axial bore therethrough and an opening at each end that comprises:

(1) a first section comprising an outer tubular member having a hollow axial bore therethrough and having a inner surface and an outer surface, and (2) a second section comprising a second material, the second section forming at least one surface of the workpiece;

(b) placing the workpiece in a subterranean wellbore that is surrounded by a geologic formation; and (c) machining the workpiece at least part of the second material from the inner surface of the inner tubular member in a predetermined pattern, thereby forming a locking profile in the inner surface of the inner tubular member.

10. The method of claim 9, further comprising the steps of placing a downhole tool in the axial bore of the workpiece and activating at least one locking member on the downhole tool to engage the locking profile on the workpiece.

11. The method of claim 9, wherein the first section comprises a tubular member having a hollow axial bore therethrough and having an inner surface and an outer surface, and wherein the tubular member comprises a plurality of apertures therein extending from the inner surface to the outer surface; and wherein the second section comprises a plurality of closure members that seal the plurality of apertures in the tubular member thereby providing a substantially smooth bore along the length of the member.

12. The method of claim 11, wherein the machining in step (c) removes sufficient second material from at least one of the apertures so as to establish a path for fluid flow between the axial bore and the outer surface of the tubular member.

13. The method of claim 12, wherein the machining in step (c) opens a fluid flow path through a plurality of the apertures.

14. The method of claim 12, wherein the path for fluid flow is located approximately at a depth in the subterranean wellbore from which hydrocarbon fluids are to be produced from the geologic formation into the wellbore.

15. The method of claim 12, wherein the path for fluid flow is located approximately at a depth in the subterranean wellbore at which fluids are to be injected from the wellbore into the geologic formation.

16. The method of claim 9, wherein the locking profile is adapted to engage locking members on a downhole tool.

17. The method of claim 16, wherein the locking profile comprises a locking recess, a sealing section, and a no-go section that has a smaller inner diameter than the locking recess or the sealing section.

18. The method of claim 9, wherein the machining in step (c) is performed by a downhole machining apparatus that is suspended within the bore of the workpiece by a structure selected from the group consisting of wireline, coiled tubing, electrical power cable, and combinations thereof.

19. A method of machining a workpiece in a subterranean wellbore, comprising the steps of:

(a) providing a landing nipple that comprises:

(1) a first section that comprises a first material, and (2) a second section that comprises a second material, the second section forming at least one surface of the workpiece;

(b) placing the landing nipple in a subterranean wellbore that is surrounded by a geologic formation; and (c) machining the landing nipple to remove at least part of the second material in the second section, whereby at least one surface of the landing nipple is formed into a desired configuration.

20. A downhole assembly, comprising:

a landing nipple located in a subterranean wellbore, the landing nipple comprising:

(1) a first section that comprises a first material, and (2) a second section that comprises a second material, the second section forming at least one surface of the landing nipple;

wherein the second material is more readily removed by machining than the first material.

* * * * *